US005633023A

United States Patent [19]

Ihara et al.

[11] Patent Number: 5,633,023

[45] Date of Patent: May 27, 1997

[54] SLIP SUPPLY SYSTEM

[75] Inventors: Yasuto Ihara; Hidemi Kotou; Suetomo Uchida; Taiichi Aso, all of Kitakyushu, Japan

[73] Assignee: Toto Ltd., Fukuoka-Ken, Japan

[21] Appl. No.: 470,276

[22] Filed: Jun. 6, 1995

[30] Foreign Application Priority Data

Jun. 8, 1994 [JP] Japan ..... 6-126190

[51] Int. Cl.[6] ..... B28B 13/00

[52] U.S. Cl. ..... 425/447; 425/84; 425/86; 425/217

[58] Field of Search ..... 425/84, 85, 86, 425/217, 447, 449

[56] References Cited

U.S. PATENT DOCUMENTS

| | | | |
|---|---|---|---|
| 3,942,563 | 3/1976 | Connors et al. | 425/447 |
| 4,664,610 | 5/1987 | Aoyama et al. | 425/84 |
| 4,994,287 | 2/1991 | Granberg et al. | 425/84 |

*Primary Examiner*—James P. Mackey

*Attorney, Agent, or Firm*—Birch, Stewart, Kolasch & Birch, LLP

[57] ABSTRACT

A slip supply system includes an annular slip supply pipe 24 with a primary pipe 24*a*, a shut-off valve 27 and a secondary pipe 24*b* connected in series. Each pouring pipe 28 which feeds slip to a casting machine 25 is connected at the upstream end thereof to the primary pipe 24*a* by way of an inlet side opening and closing valve 29. Each pouring pipe 28 is connected at the downstream end thereof to the secondary pipe 24*b* by way of an outlet side opening and closing valve 30. With the shut-off valve 27 being open and both opening and closing valves 29 and 30 being closed, slip is fed under pressure by a pressure feeding device 23*b*. The slip fed under pressure is passed through the annular slip supply pipe 24 and is returned to re-purifying facilities 23*a*, so that the interior of the annular slip supply pipe 24 is displaced by new slip. With the shut-off valve 27 being closed and both opening and closing valves 29 and 30 being open, slip is fed under pressure by the pressure feeding device 23*b*, so that the interior of each pouring pipe 28 is displaced by new slip.

8 Claims, 4 Drawing Sheets

SLIP SUPPLY SYSTEM

FIELD OF THE INVENTION

This invention relates to a slip supply system for supplying slip to casting devices for producing pieces of sanitary ware or the like and, more particularly, to a slip supply system for supplying slip with stable properties to casting molds.

BACKGROUND OF THE INVENTION

FIG. 6 shows an example of a production facility for producing sanitary ware by slip casting, in which slip prepared and purified in a raw material-preparation room 1 is fed to a casting room 2 by way of a slip supply main pipes 4 by slip feeding facilities 3. Each slip supply main pipe 4 branches off in the casting room 2 and is connected to a pouring pipe 6 of each casting machine 5. The ends of the slip supply main pipes 4 and pouring pipes 6 are of a blind construction.

FIG. 7 shows the composition of a slip pipe from the slip supply main pipe 4 to each of the pouring pipes 6 and the composition of a pipe arrangement within the casting machine 5, in which a plurality of molds 7 are mounted on the casting machine 5 and each mold 7 is connected to the pouring pipe 6 through a pouring hose 8 having a pouring valve 9. The slip which has been fed by the slip feeding facilities 3 is replenished in a head tank 11 within the casting machine 5 by way of a head tank replenishing valve 10, and is supplied from the head tank 11 to each mold 7 by way of a slip supply valve 12, a pouring pipe 6, a pouring valve 9 and a pouring hose 8. A slip tank 13 for recovering surplus slip produced in a slip discharge process is provided at the end of the pouring pipe 6 by way of a slip discharge pipe 14 in every casting machine 5.

In the above-described slip supply system, since one cycle of a slip casting using plaster molds requires a long time, say, one to three hours, a temperature of the slip within the slip supply main pipe 4 for use in the following cycle of casting drops and the basic properties of slip such as viscosity, a slip casting rate and the like change. If a casting operation is performed with the slip having changed in properties, there is a problem in that the thickness of the formed product changes and, when the formed product is removed from the plaster mold, it becomes deformed and is cracked. Such an inclination remarkably appears at the time of performing a casting operation after the stoppage of a long time, i.e., at the time of a commencement of work.

Further, there is a problem in that when slip remains for a long time at night or during a holiday, it adheres gradually to the inner wall of the pipe and forms solid matter. As such adhesion proceeds, an area of cross section of the pipe through which slip passes becomes small and brings about great resistance in the pipe. Thus, the time taken to supply slip to the plaster molds becomes longer and a casting cycle is extended.

Moreover, when a casting operation is performed, solid matter peels off from the inner wall of the pipe by a pressure of slip and is supplied to the interiors of the molds together with slip, thereby causing defects to be produced in the formed products. Particularly, the pouring pipe 6 of the casting machine 5 shown in FIG. 7 has a problem in that since the interior of the pipe becomes empty due to the discharge of slip, the slip adhered to the inner wall of the pipe is apt to dry and firmly stick thereto.

Further, when the casting machine 5 is allowed to stand in a condition of rest for a long time, there is a danger of the slip within the pipe becoming completely solidified to consequently clog the pipe, thereby making it impossible to use the pouring pipe 6 of the casting machine 5 and the slip supply main pipe 4 again.

SUMMARY OF THE INVENTION

It is therefore an object of the invention to provide a slip supply system which prevents slip from sticking to the interior of the pipes, and to allow slip which is stable in properties to be supplied to the casting molds, so that formed products stable in properties can be obtained.

Another object of the invention is to provide a slip supply system which reduces resistance in the pipe and which also allows the casting room to be effectively utilized.

A further object of the invention is to provide a slip supply system which allows slip stable in properties to be supplied to a plurality of casting facilities.

Still a further object of the invention is to provide a slip supply system wherein there exists no danger of scatter being caused in the operations of displacement of slip even in the case where a large number of slip pouring pipes exist.

Still a further object of the invention is to provide a slip supply system which has no danger of the pipe being clogged even if the casting facilities are stopped for a long time.

According to one aspect of the invention, there is provided a slip supply system which comprises:

a slip supply means;

casting facilities;

an annular slip supply pipe which supplies slip from said slip supply means to said casting facilities and which recovers slip from said casting facilities to said slip supply means;

a shut-off valve provided on the way of said annular slip supply pipe; and one or more slip pouring pipes in said casting facilities which are connected at one end thereof to the upstream side of said shut-off valve and which are connected at the other end to the downstream side of said shut-off valve, said shut-off valve being opened when slip from said slip supply means is supplied to said annular slip supply pipe to displace the slip therein, and being closed when slip from said slip supply means is supplied to said slip pouring pipes to displace the slip therein.

According to another aspect of the invention, there is provided a slip supply system which comprises:

a slip supply means;

casting facilities;

a plurality of annular slip supply pipes which supply slip from said slip supply means to said casting facilities and which recover slip from said casting facilities to said slip supply means;

shut-off valves each provided on the way of each of said annular slip supply pipes; and slip pouring pipes in said casting facilities which are connected at one end thereof to an arbitrary one of said annular slip supply pipes at the upstream side of said shut-off valve, and at the other end to the other annular slip supply pipe at the downstream side of said shut-off valve, said shut-off valves each being opened when slip from said slip supply means is supplied to each of said annular slip supply pipes to displace the slip therein, and being closed when slip from said slip supply means is supplied to said slip pouring pipes to displace the slip therein.

In further accordance with the invention, a slip supply system further includes an inlet side opening and closing valve at the upstream end of each of said slip pouring pipes and an outlet side opening and closing valve at the downstream end thereof, both of said opening and closing valves being closed as the slip within said annular slip supply pipes is displaced, and said slip pouring pipes being opened as the slip therein is displaced.

In still further accordance with the invention, said slip pouring pipes are connected in parallel to said annular slip supply pipes.

According to another aspect of the invention, said slip pouring pipes are divided into a plurality of blocks each consisting of an arbitrary number of said slip pouring pipes, and the displacement of slip within said slip pouring pipes is performed in every said block.

According to another aspect of the invention, the displacement of slip within said annular slip supply pipes and said slip pouring pipes is performed periodically.

The slip supply system according to the invention is provided with a shut-off valve on the way of the annular slip supply pipe. In operation, with the shut-off valve being open, slip from the slip supply means is supplied to the annular slip supply pipe so that the slip therein is displaced. With the shut-off valve being closed, slip from the slip supply means is supplied to the slip pouring pipes to thereby displace slip therein. This makes it possible to prevent slip from firmly sticking to the interior of the pipes, thereby allowing slip stable in properties to be supplied to the casting molds.

Further, in the invention, a plurality of annular slip supply pipes are provided. This makes it possible to shorten the individual annular slip supply pipes and to lessen resistance within a pipe. Thus, the scale and arrangement of the casting facilities comes to be free, thereby allowing the casting room to be utilized effectively.

Moreover, in the invention, the slip pouring pipes are provided at the upstream and downstream ends thereof with an inlet side opening and closing valve and an outlet side opening and closing valve, respectively, and both opening and closing valves are closed at the time of the displacement of slip within the annular slip supply pipe. This allows the displacement of slip within the annular slip supply pipe to be surely performed in a short time even in the case where the annular slip supply pipe is long.

Further, in the invention, the plurality of slip pouring pipes are connected in parallel to the annular slip supply pipe. This allows slip stable in properties to be supplied to a plurality of casting facilities.

Moreover, in the invention, the slip pouring pipes are divided into a plurality of blocks, and the displacement of slip within the slip pouring pipes is performed in every block. This eliminates the production of scatter in the operations of displacing slip even in the case where the number of the slip pouring pipes is high.

In addition, in the invention, the displacement of slip within the pipes is periodically performed. This eliminates an occurrence of the pipes being clogged even if the casting facilities are stopped for a long time.

BRIEF DESCRIPTION OF THE DRAWINGS

Other objects and aspects of the invention will be become apparent from the following description of embodiments with reference to the accompanying drawings in which.

DETAILED DESCRIPTION OF PREFERRED EMBODIMENTS

Now, an embodiment of the present invention will be described with reference to the drawings.

Figure 1:
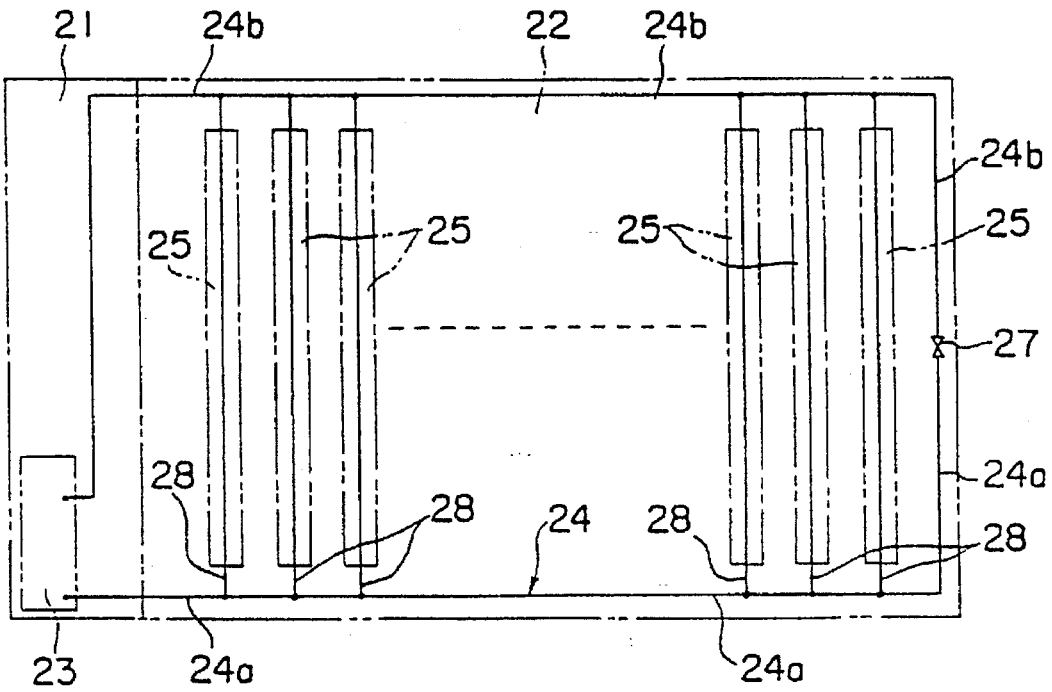
FIG. 1 is a plan view showing a slip supply system of a first embodiment according to the invention.
Figure 2:
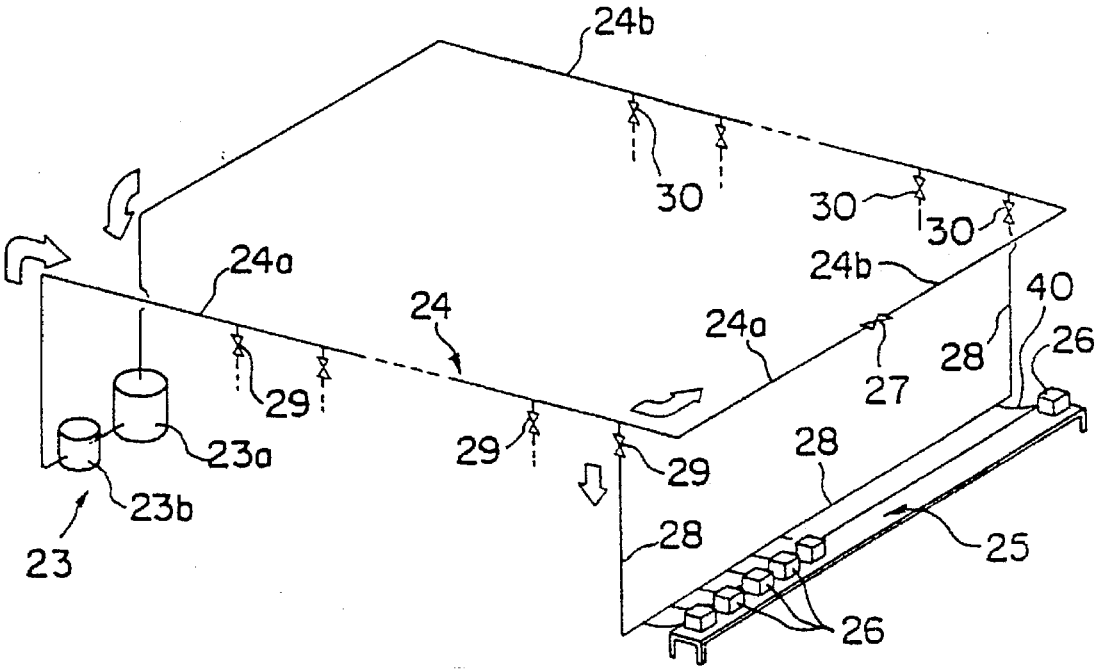
FIG. 2 is a perspective view of an essential portion of the slip supply system in FIG. 1.

FIGS. 1 and 2 show a slip supply system of a first embodiment according to the present invention. A raw material-preparation room 21, and a casting room 22 are provided. In the raw material preparation room 21, slip feeding facilities 23 are provided for preparing and purifying slip. The slip feeding facilities 23 comprise purifying facilities **23*a* for storing the recovered slip and preparing the properties thereof and a pressure feeding means 23*b* for feeding the purified slip to the casting room 22**.

In the casting room 22 a plurality of casting machines 25, are provided, on each of which a plurality of casting molds 26 are mounted.

Between the raw material-preparation room 21 and the casting room 22 is arranged an annular slip supply pipe 24 for feeding the slip purified in the slip feeding facilities 23 to the casting room 22, and the annular slip supply pipe 24 consists of a loop pipe which circulates in the casting room 22 and which is returned to the slip feeding facilities 23 again.

This annular slip supply pipe 24 is constituted by connecting a primary pipe **24*a* and a secondary pipe 24*b* in series by way of a shut-off valve 27, which is controlled so to be opened and closed at the time of the displacement of slip which will be described later. Pouring pipes 28 of the casting machines 25 are connected at one end thereof to the primary pipe 24*a* and at the other end to the secondary pipe 24*b***, said pouring pipes being in parallel to each other.

Figure 3:
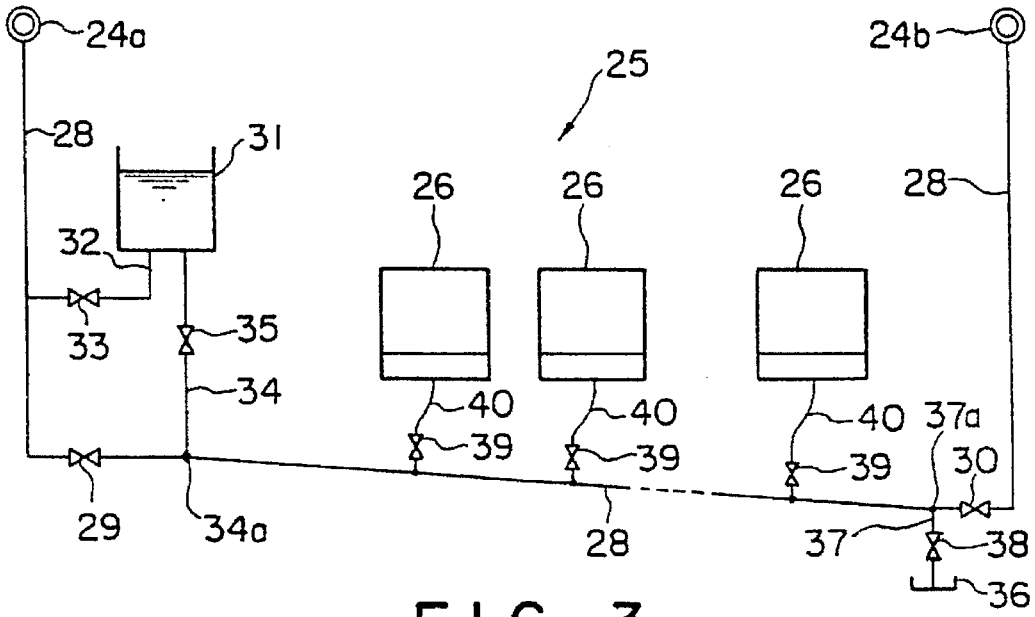
FIG. 3 is an explanative view showing the composition of a pipe arrangement within a casting machine.

FIG. 3 shows a pipe connection in the casting machine 25 in detail. The pouring pipe 28 is connected to the primary pipe **24*a* of the annular slip supply pipe 24 by way of an inlet side opening and closing valve 29 and, simultaneously, is connected to the secondary pipe 24*b* by way of an outlet side opening and closing valve 30**.

Further, a head tank 31 is provided in every casting machine 25 to stabilize a pouring pressure uniformly. A head tank supply pipe 32 branches off from a primary side of the inlet side opening and closing valve 29 and is connected to the head tank 31 by way of a head tank-replenishing valve 33, and a downwardly extending pipe 34 is connected to a secondary side of the inlet side opening and closing valve 29 from the head tank 31 by way of a slip supply valve 35.

A slip tank 36 is provided in every casting machine 25 to recover the surplus slip produced in a slip discharge process, and is disposed below a slip discharge valve 38 and a slip discharge branch pipe 37 which branches off from a primary side of the outlet side opening and closing valve 30 at the end of the pouring pipe 28.

Moreover, each casting mold 26 is connected to the pouring pipe 28 by way of a pouring hose 40 having a pouring valve 39 between the junction 34*a* of the rising pipe 34 and the junction 37*a* of the slip discharge branch pipe 37.

Now, the operation of the present embodiment will be described.

A displacement of slip within the annular slip supply pipe 24 and the pouring pipes 28 is performed before supplying slip to the casting molds 26.

In the displacement of slip within the annular slip supply pipe 24, both opening and closing valves 29 and 30 of each pouring pipe 28 are first closed and the shut-off valve 27 is opened. Thereafter, slip is fed to the annular slip supply pipe 24 under a pressure of 0.1 MPa–1.0 MPa applied to the slip by the pressure feeding means 23*b*. The slip is passed through the annular slip supply pipe 24 and is recovered into the re-purifying facilities 23*a*, thereby performing the displacement of slip within the annular slip supply pipe 24.

Next, in the displacement of slip within the pouring pipe 28, after the shut-off valve 27 is first closed, a pressure of 0.1 MPa–1.0 MPa is applied to the primary pipe 24*a* of the annular slip supply pipe 24 by the pressure feeding means 23*b*. Thereafter, with the valves 33, 35, 38 and 39 being closed, the opening and closing valves 29 and 30 at both ends of the pouring pipes 28 are opened. Hereupon, the slip within the primary pipe 24*a* is passed through the pouring pipes 28 and is discharged to the secondary pipe 24*b*, thereby performing the displacement of slip within the pouring pipes 28.

The slip fed under pressure in this way peels off the slip adhered to the inner walls of the pipes 24 and 28 and solidified thereon and, simultaneously, the old slip, which has remained in the pipes 24 and 28 and changed in properties, is displaced by the new slip immediately after completion of the purification. This allows slip stable in properties to be supplied to the casting molds 26, thereby making it possible to provide molded products stable in quality.

Hereupon, the displacement of slip within the pouring pipes 28 can be simultaneously performed in all the casting machines 25; however, if slip is passed through a large number of pouring pipes 28 simultaneously, there is a danger of scatter being produced in the operations of displacing slip. From this reason, a large number of pouring pipes 28 are preferably divided into blocks each consisting of one, two or more pouring pipes, and the operations of displacing slip are performed in every block in order.

Further, in the case where the casting machines 25 are stopped for a long time, it is preferable to periodically perform the displacement of slip within both pipes 24 and 28, thereby preventing clogging in the pipes 24 and 28 from occurring.

In this connection, performing the displacement of slip is possible by supplying slip to the head tank 31 and extracting it therefrom to the slip tank 36; however, since the head pressure of the head tank 31 is low, i.e., in a range of 0.01 MPa–0.02 MPa, a sufficient effect of the displacement cannot be obtained and, in addition, a working load for treatment of slip discharged into the slip tank 36 is increased which is not practical.

Figure 4:
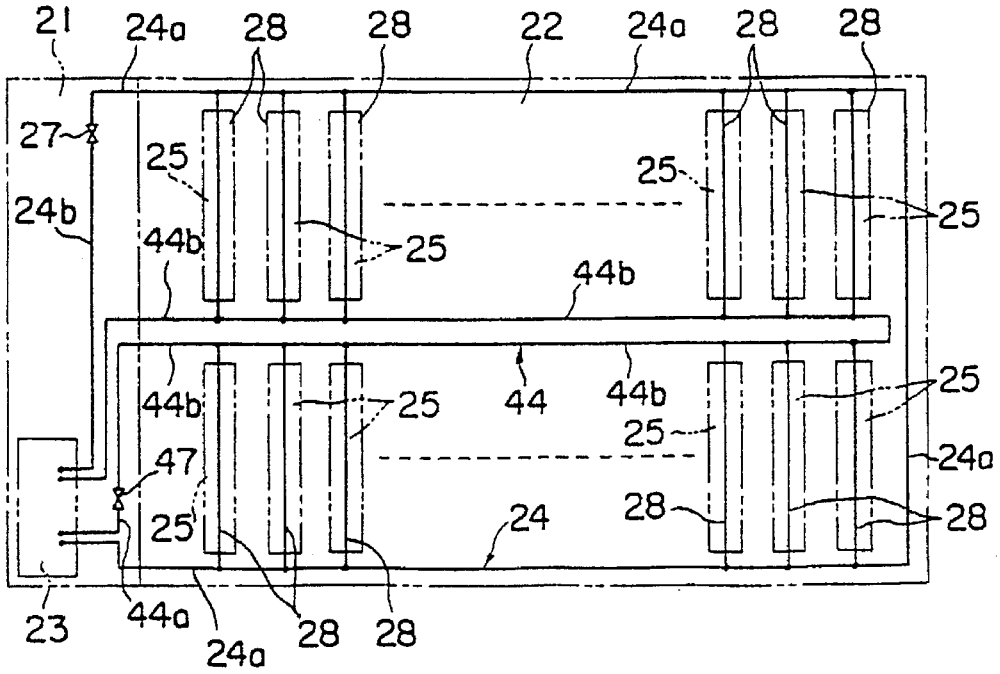
FIG. 4 is a plan view showing a slip supply system of a second embodiment according to the invention.
Figure 5:
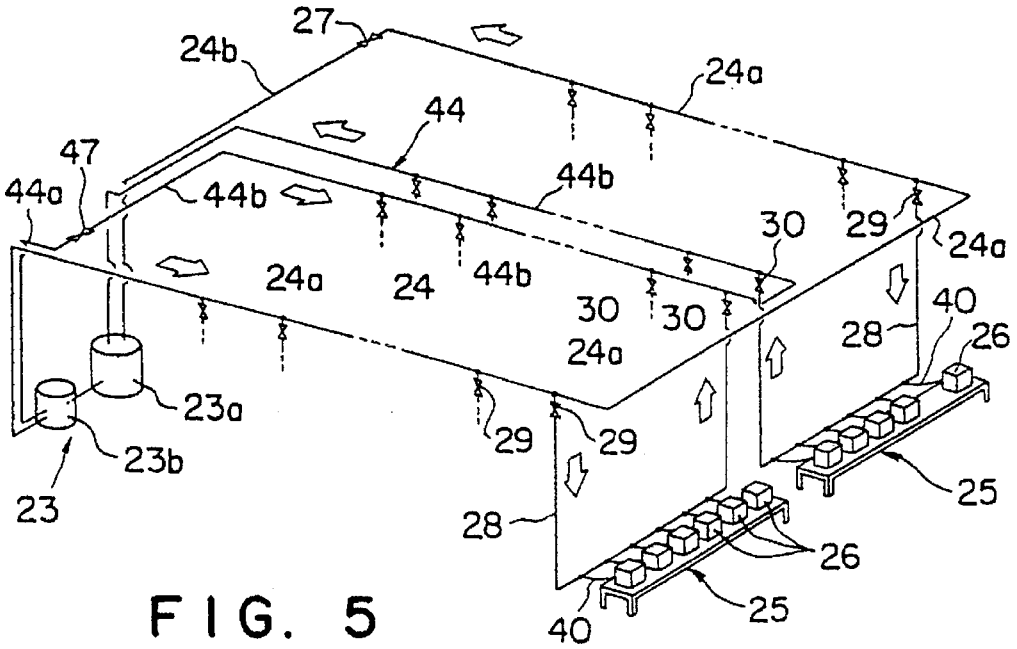
FIG. 5 is a perspective view of an essential portion of FIG. 4.
Figure 6:
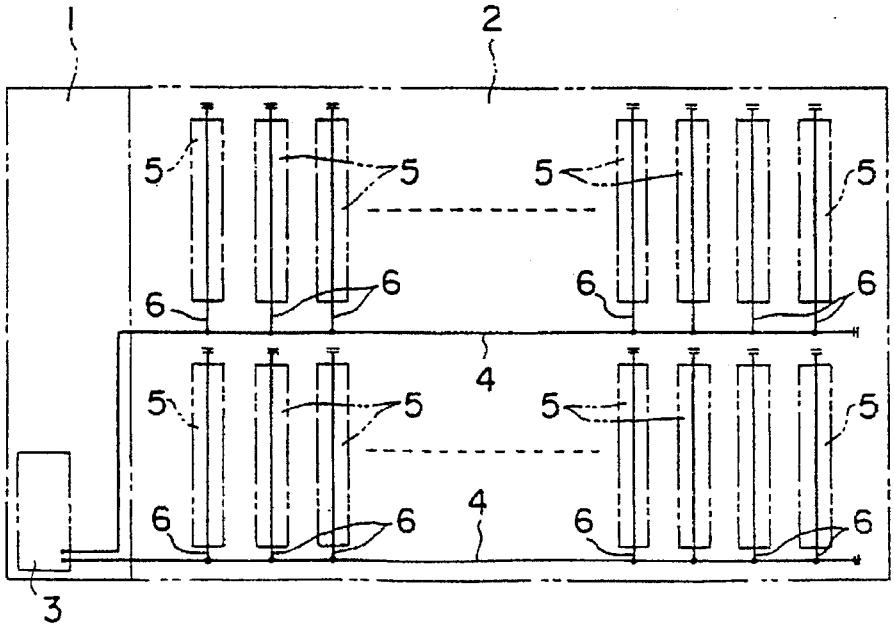
FIG. 6 Prior Art
FIG. 6 is a plan view showing an example of a slip supply system.
Figure 7:
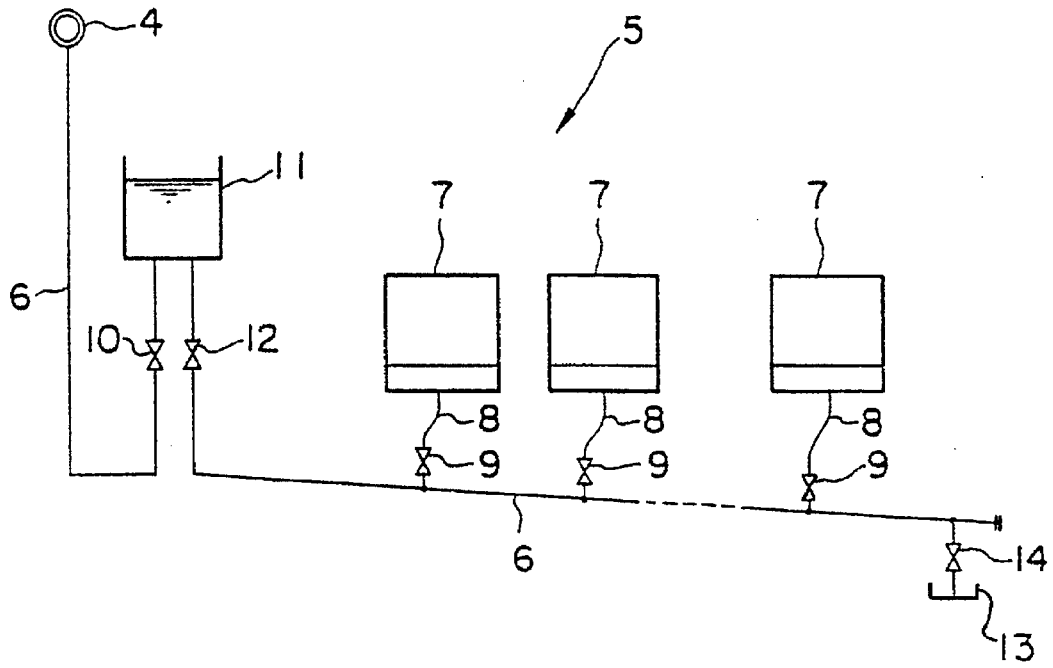
FIG. 7 Prior Art
FIG. 7 is an explanative view showing an example of the composition of a pipe arrangement within a casting machine.

FIGS. 4 and 5 show a slip supply system of a second embodiment according to the present invention, in which a plurality of annular slip supply pipes are provided, and in the displacement of slip within the pouring pipes, the slip supplied from one of the annular slip supply pipes is discharged to the other annular slip supply pipe.

Namely, between the raw material preparation room 21 and the casting room 22 is provided an annular slip supply pipe 44 in addition to the annular slip supply pipe 24, and this annular slip supply pipe 44 is so constituted that a primary pipe 44*a* and a secondary pipe 44*b* are connected in series by way of a shut-off valve 47. Each pouring pipe 28 is connected at one end thereof to the primary pipe 24*a* of the annular slip supply pipe 24 by way of an inlet side opening and closing valve 29 and, simultaneously, at the other end to the secondary pipe 44*b* of the annular slip supply pipe 44 by way of an outlet side opening and closing valve 30. The pouring pipes 28 are connected in parallel to each other.

The remaining construction is the same as that of the above-described first embodiment.

Now, the operation of the present embodiment will be described.

In the displacement of slip within the annular slip supply pipes 24 and 44, the shut-off valves 27 and 47 are first opened and both opening and closing valves 29 and 30 of each pouring pipe 28 are closed. Further, slip is fed under pressure to both annular slip supply pipes 24 and 44 by the pressure feeding means 23*b*. Thus, the displacement of slip within both annular slip supply pipes 24 and 44 is performed.

Next, in the displacement of slip within each pouring pipe 28, the shut-off valves 27 and 47 are first closed, and the pressure of slip is applied to the primary pipe 24*a* of the annular slip supply pipe 24 and, thereafter, both opening and closing valves 29 and 30 of each pouring pipe 28 are opened. Hereupon, the slip within the primary pipe 24*a* is passed through each pouring pipe 28 and is discharged to the secondary pipe 44*b* of the annular slip supply pipe 44, so that the displacement of slip within each pouring pipe 28 is performed.

Thus, in the case where one annular slip supply pipe 24 is used for both supply and recovery of slip, as in the above-described embodiment, the cost for facilities becomes cheaper. However, the slip supply ports to the casting machines 25 are shifted to one side of a plant, as shown in FIG. 2, thereby resulting in the limited arrangement of the casting machines 25. On the contrary, in the present embodiment, taking out slip in all areas within the plant using the plurality of annular slip supply pipes 24 and 44 is made possible. Thus, one annular slip supply pipe becomes shorter in length, and brings about less resistance within a pipe and, simultaneously, the scale and arrangement of the casting machines 25 comes to be free and the casting room 22 can be effectively utilized.

As described above, in the present invention the shutoff valve is provided on the way of the annular slip supply valve, and in the displacement of slip within the annular slip supply pipe, the shut-off valve is opened, and in the displacement of slip within the slip pouring pipes, the shut-off valve is closed. Thus, slip firmly sticking to the interior of the pipe is prevented to consequently supply slip stable in properties to the casting molds, thereby allowing the formed products stable in quality to be provided.

Since in the present invention a plurality of annular slip supply pipes are provided, the individual annular slip supply pipes become shorter in length and brings about less resistance within a pipe, and in addition, the scale and arrangement of the casting facilities comes to be free, allowing the casting room to be utilized effectively.

In the present invention, each slip pouring pipe is provided at the upstream and downstream ends thereof with inlet and outlet opening and closing valves, respectively, which are controlled so as to be opened and closed in the displacement of slip. Thus, the displacement of slip within the pipes can be surely performed in a short time.

Since in the present invention the plurality of slip pouring pipes are connected in parallel to the annular slip supply pipe, slip stable in properties can be supplied to a plurality of casting facilities.

Since in the present invention the slip pouring pipes are divided into a plurality of blocks and the displacement of slip is performed in every block, there is no danger of scatter being produced in the operations of displacing slip even in the case where a large number of slip pouring pipes exist.

Since in the present invention the displacement of slip within the pipes is performed periodically, no pipe is clogged even if the casting facilities are stopped for a long time.

What is claimed:

1. A slip supply system comprising:

a slip supply means;

casting facilities;

an annular slip supply pipe for supplying slip from said slip supply means to said casting facilities and for recovering slip from said casting facilities to said slip supply means;

a shut-off valve operatively connected to said annular slip supply pipe; and one or more slip pouring pipes in said casting facilities being connected at one end thereof to the supply pipe at the upstream side of said shut-off valve and being connected at the other end thereof to the supply pipe at the downstream side of said shut-off valve;

said shut-off valve being opened when slip from said slip supply means is supplied to said annular slip supply pipe to displace the slip therein, and being closed when slip from said slip supply means is supplied to said slip pouring pipes to displace the slip therein.

2. A slip supply system comprising:

a slip supply means;

casting facilities;

a plurality of annular slip supply pipes for supplying slip from said slip supply means to said casting facilities and for recovering slip from said casting facilities to said slip supply means;

shut-off valves each operatively connected to one of each of said annular slip supply pipes; and slip pouring pipes in said casting facilities being connected at one end thereof to a selected one of said annular slip supply pipes at the upstream side of a predetermined shut-off valve, and at the other end to another annular slip supply pipe at the downstream side of the predetermined shut-off valve;

said shut-off valves each being opened when slip from said slip supply means is supplied to each of said annular slip supply pipes to displace the slip therein, and being closed when slip from said slip supply means is supplied to said slip pouring pipes to displace the slip therein.

3. The slip supply system as claimed in claim 1, and further including an inlet side opening and closing valve at the upstream end of each of said slip pouring pipes and an outlet side opening and closing valve at the downstream end thereof, both of said opening and closing valves being closed as the slip within said annular slip supply pipe is displaced, and said opening and closing valves being opened as the slip therein is displaced.

4. The slip supply system as claimed in claim 1, wherein said slip pouring pipes are connected in parallel to said annular slip supply pipe.

5. The slip supply system as claimed in claim 4, wherein said slip pouring pipes are divided into a plurality of sections each consisting of an arbitrary number of said slip pouring pipes, and the displacement of slip within said slip pouring pipes is performed in every said section.

6. The slip supply system as claimed in claim 2, and further including an inlet side opening and closing valve at the upstream end of each of said slip pouring pipes and an outlet side opening and closing valve at the downstream end thereof, both of said opening and closing valves being closed as the slip within said annular slip supply pipes is displaced, and said opening and closing valves being opened as the slip therein is displaced.

7. The slip supply system as claimed in claim 2, wherein said slip pouring pipes are connected in parallel to said annular slip supply pipes.

8. The slip supply system as claimed in claim 2, wherein said slip pouring pipes are divided into a plurality of sections each consisting of an arbitrary number of said slip pouring pipes, and the displacement of slip within said slip pouring pipes is performed in every said section.

* * * * *